US006397763B1

(12) United States Patent
Panzarella et al.

(10) Patent No.: US 6,397,763 B1
(45) Date of Patent: Jun. 4, 2002

(54) ADJUSTABLE SUPPORT APPARATUS

(75) Inventors: Thomas A. Panzarella, Blue Bell; David D. McClanahan, Harleysville, both of PA (US)

(73) Assignee: Cook Technologies, Inc., Green Lane, PA (US)

( * ) Notice: Subject to any disclaimer, the term of this patent is extended or adjusted under 35 U.S.C. 154(b) by 0 days.

(21) Appl. No.: 09/859,235

(22) Filed: May 17, 2001

(51) Int. Cl.[7] ..... A47B 11/00
(52) U.S. Cl. ..... 108/138; 248/284.1; 108/145
(58) Field of Search ..... 248/918, 920, 248/923, 429, 284.1, 286.1; 108/138, 145, 96, 4, 6, 9, 10; 312/27

(56) References Cited

U.S. PATENT DOCUMENTS

| | | | | |
|---|---|---|---|---|
| 3,744,891 A | | 7/1973 | Dennis et al. | 353/27 |
| 4,496,200 A | | 1/1985 | Hagstrom et al. | 312/208 |
| 4,625,657 A | | 12/1986 | Little et al. | 108/93 |
| 4,644,875 A | | 2/1987 | Watt | 108/93 |
| 4,706,919 A | | 11/1987 | Soberalski et al. | 248/281.1 |
| 4,768,744 A | | 9/1988 | Leeds et al. | 248/280.1 |
| 4,836,486 A | | 6/1989 | Vossoughi et al. | 248/281.1 |
| 5,037,054 A | | 8/1991 | McConnell | 248/284 |
| 5,098,053 A | | 3/1992 | Cotterill | 248/281.1 |
| 5,348,260 A | | 9/1994 | Acevedo | 248/280.1 |
| 5,377,951 A | | 1/1995 | Johnson et al. | 248/639 |
| 5,390,904 A | | 2/1995 | Rivard et al. | 267/204 |
| 5,487,525 A | | 1/1996 | Drabczyk et al. | 248/639 |
| 5,609,316 A | | 3/1997 | Tigliev | 248/123.11 |
| 5,652,985 A | | 8/1997 | Wilkinson et al. | 5/710 |
| 5,683,064 A | | 11/1997 | Copeland et al. | 248/278.1 |
| 5,697,303 A | | 12/1997 | Allan | 108/93 |
| 5,707,034 A | | 1/1998 | Cotterill | 248/284.1 |
| 5,765,797 A | | 6/1998 | Greene et al. | 248/398 |
| 5,778,799 A | | 7/1998 | Eyre | 108/7 |
| 5,791,263 A | | 8/1998 | Watt et al. | 108/138 |
| 5,823,487 A | | 10/1998 | Kirchhoff et al. | 248/118 |
| 5,857,415 A | | 1/1999 | Richard | 108/50.01 |
| 5,915,657 A | * | 6/1999 | Ptak | 108/138 |
| 6,116,557 A | * | 9/2000 | Choy et al. | 248/918 |
| 6,227,508 B1 | | 5/2001 | Panzarella et al. | 248/118 |

* cited by examiner

*Primary Examiner*—Peter M. Cuomo
*Assistant Examiner*—Jerry A. Anderson
(74) *Attorney, Agent, or Firm*—Woodcock Washburn LLP

(57) ABSTRACT

An adjustable support apparatus for supporting an object, such as a keyboard. The apparatus has a rotatable support arm to which a rotatable support member is attached. Rotation of the support arm allows the height of the support plate to be adjusted. Rotation of the support member allows its inclination to be adjusted. A four bar linkage mechanism ensures that the inclination of the support member remains constant despite variation in the angular orientation of the support arm. The support arm is locked from downward rotation by the interaction of a ring segment, formed on one of the links of the four bar linkage mechanism, with pins projecting from the base. The locking is disengaged by tilting the support member upward. A ratchet and pawl mechanism locks the inclination of the support member.

26 Claims, 12 Drawing Sheets

FIG.15(a)
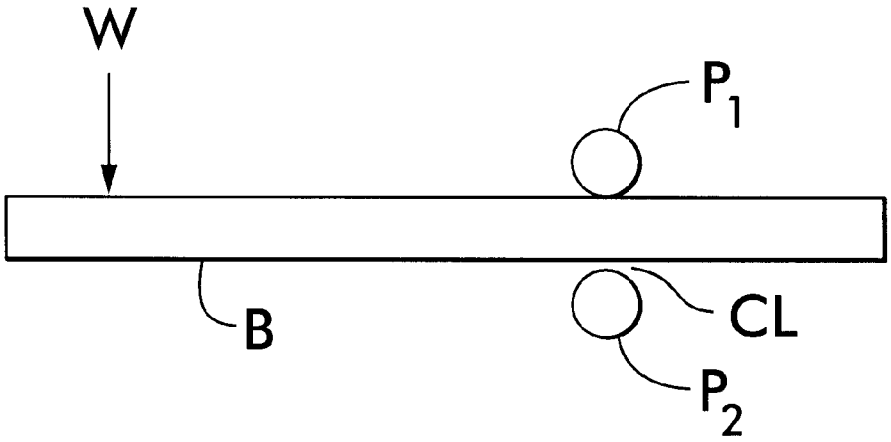
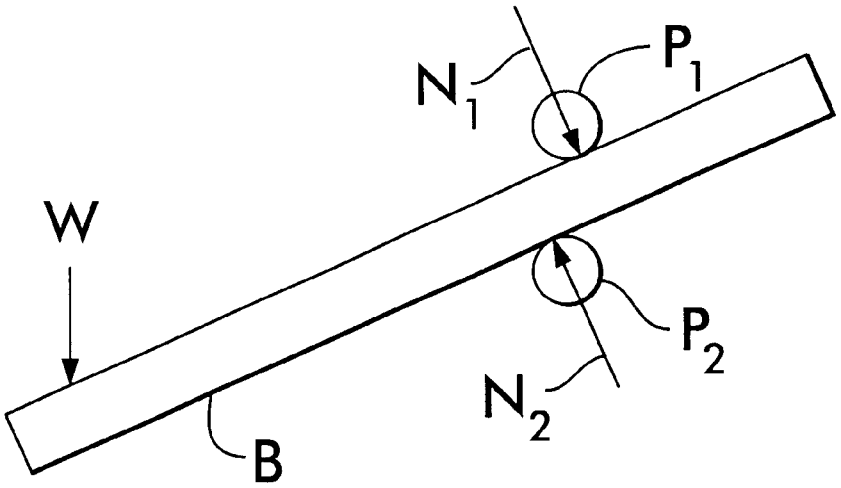
FIG.15(b)

FIG.16(a)
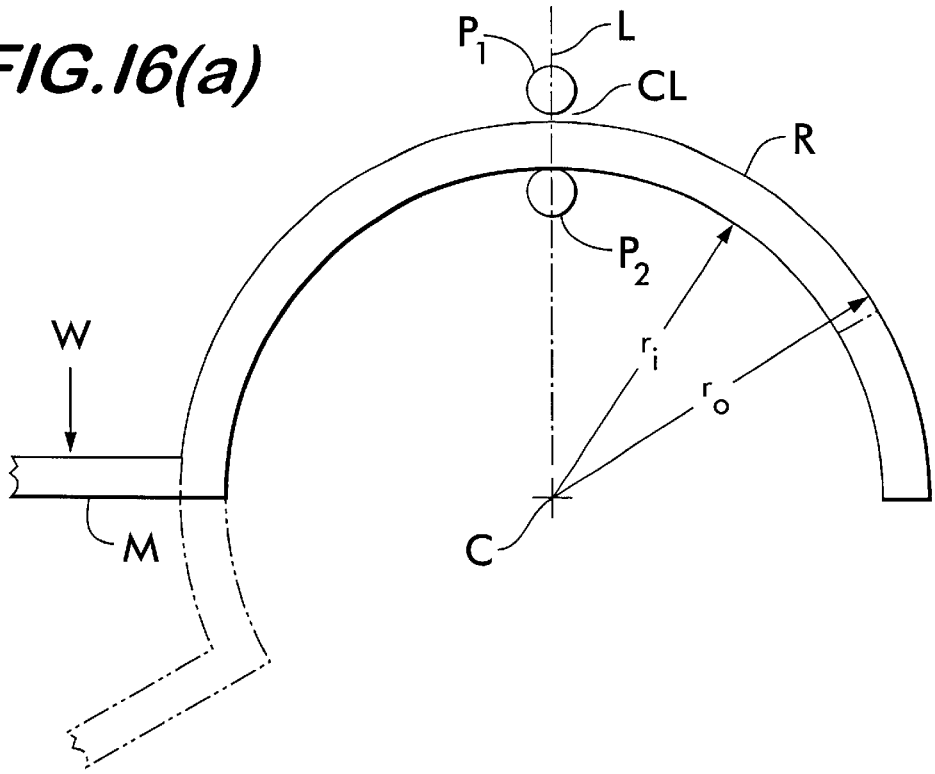
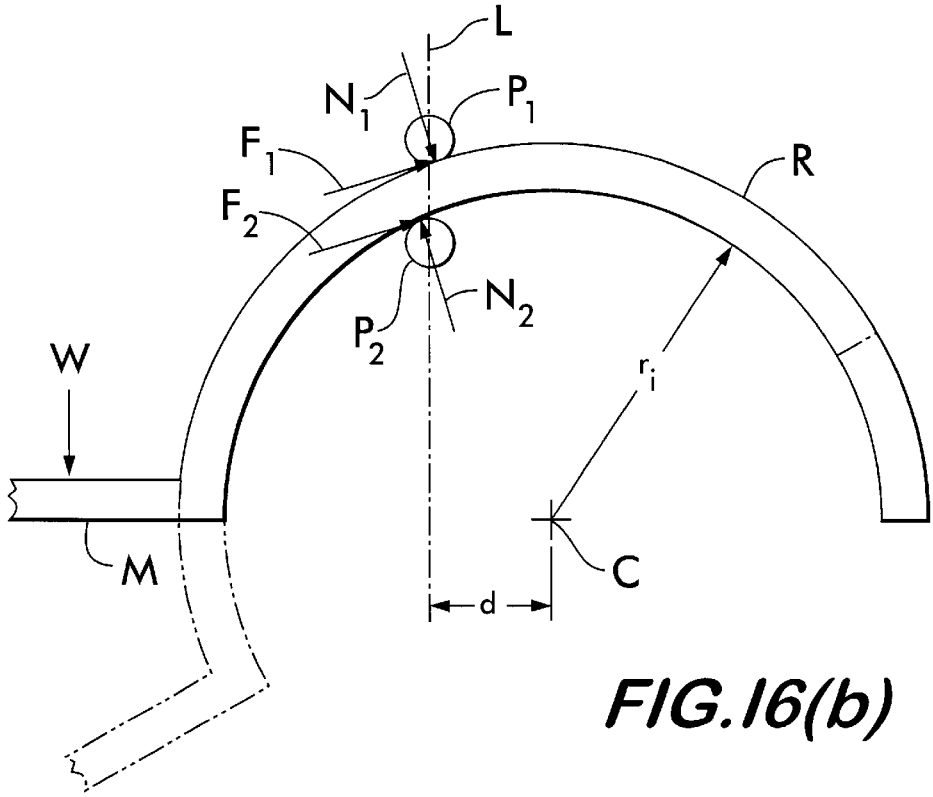
FIG.16(b)

FIG.18(a)
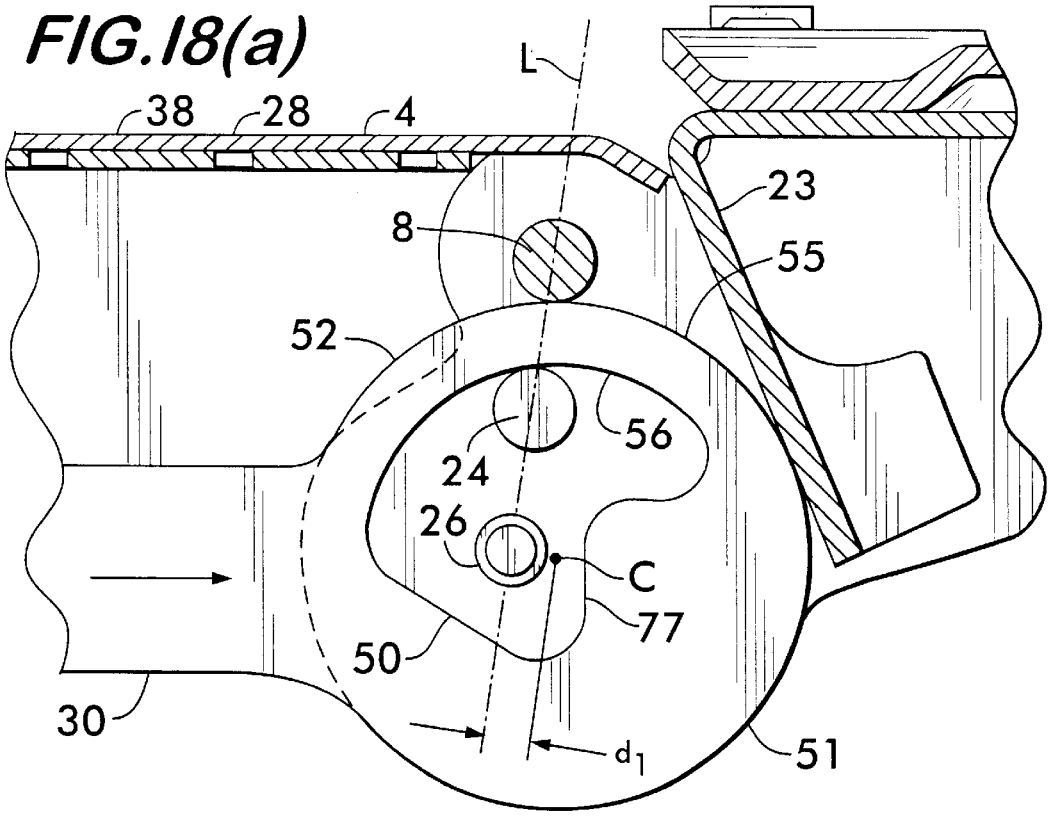
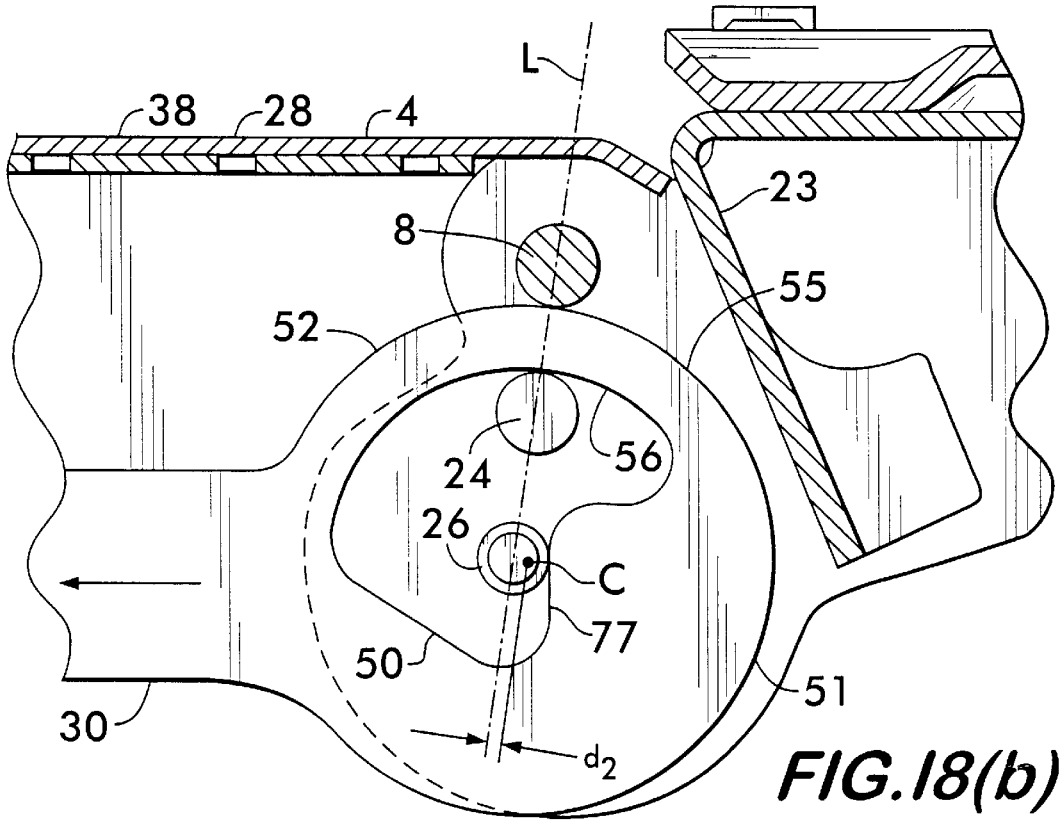
FIG.18(b)

FIG.19
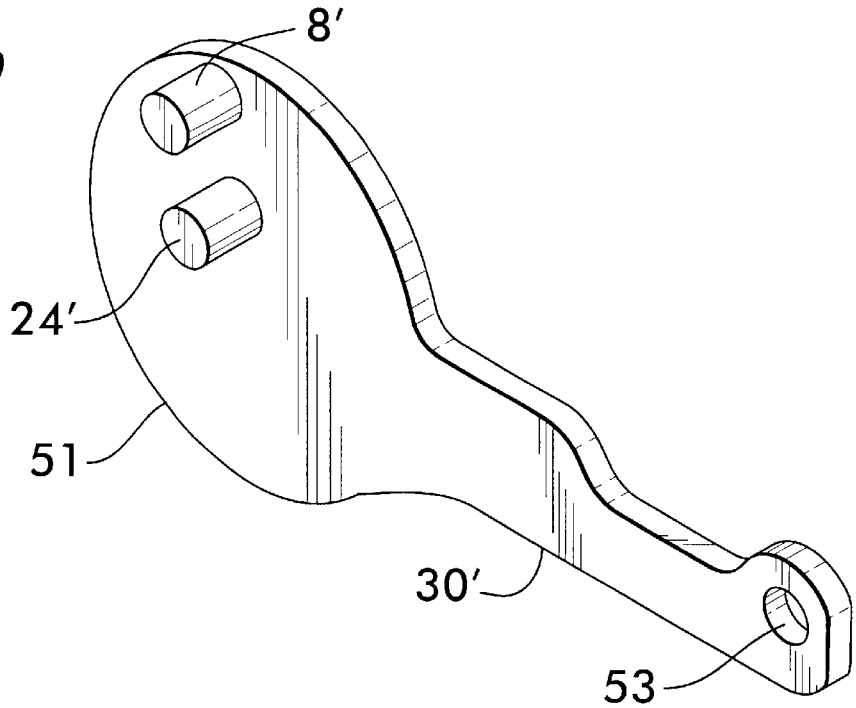
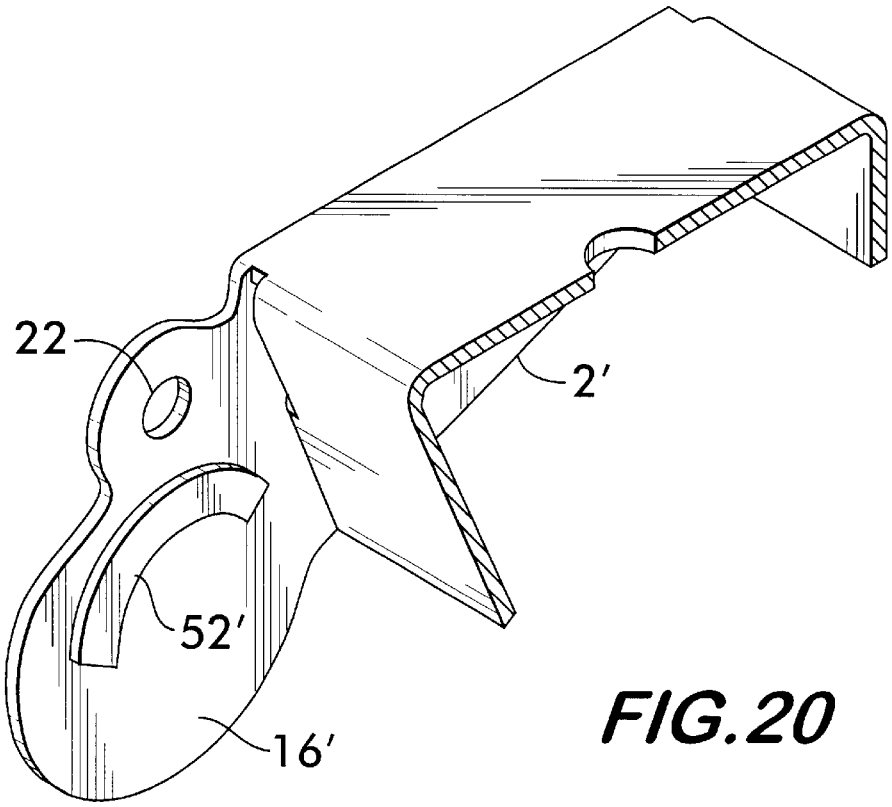
FIG.20

ADJUSTABLE SUPPORT APPARATUS

FIELD OF THE INVENTION

The current invention is directed to an apparatus for providing an adjustable support for an object, such as that used to support visual monitors or computer keyboards.

BACKGROUND OF THE INVENTION

Certain objects, such as data entry keyboards for use in connection with a computer and visual monitors, have been mounted on a support surface formed on an adjustable support apparatus that permits varying the height, as well as the inclination, of the support surface. Varying the height and inclination of the object reduces strain on the user. For example, varying the height and inclination of a keyboard permits its positioning to be adapted to the characteristics and preferences of the user and can prevent carpel tunnel syndrome.

In the past, apparatus for supporting keyboards have included an arm, the proximal end of which was rotatably mounted on a base that was typically affixed to the underside of a desk. A support plate, on which the keyboard is mounted, is rotatably mounted on the distal end of the arm. Rotating the arm up or down at the base allows the height of the keyboard to be adjusted, while rotation of the support plate on the arm allows the inclination of the keyboard to be adjusted. A device, such as a torsion spring, is typically used to offset the weight moment tending to rotate the support arm downward when it is unlocked. Another approach to offsetting the weight moment involves the use of a gas filled cylinder, similar to those used to restrain downward motion of the tailgate or hatch back in an automobile. Still another device makes use of a constant force spring, such as that disclosed in U.S. Pat. No. 6,227,508 (application Ser. No. 09/248,403, filed Feb. 12, 1999), hereby incorporated by reference in its entirety.

Various locking mechanisms have been used to lock the support arm and support plate in the desired orientations. Some devices employ two or more knobs or levers to effect complete locking or unlocking—for example, one knob to lock/unlock the support arm and another to lock/unlock the support plate. Consequently, adjustment of the apparatus is cumbersome. In addition, the inclination of the support plate varies as the arm is rotated up and down, whereas the user will often desire to maintain a constant horizontal inclination for the keyboard regardless of its height. Consequently, in many prior art devices, resetting the height of the keyboard will also necessitate resetting the inclination.

Aforementioned U.S. Pat. No. 6,227,508 discloses an apparatus that allows the user to maintain constant inclination of the support plate as the support arm rotates and that employs ratchet and pawls to lock rotation of the support arm and the support plate. Unfortunately, the ratchet and pawl mechanism for locking the support arm does not give a smooth feel to the user and can create unacceptable noise in an office environment. Also, the ratchet and pawl limits the support arm height adjustment to incremental movement.

Consequently, it would be desirable to provide an improved adjustable support apparatus for an object, such as a keyboard or a visual monitor.

SUMMARY OF THE INVENTION

It is an object of the current invention to provide an improved adjustable support apparatus for an object, such as a keyboard or a visual monitor. This and other objects is accomplished in an adjustable support apparatus for supporting an object thereon that can be adjusted by a user that comprises (a) a base; (b) a rotatable support arm capable of rotation relative to the base over at least a range of angular orientations, the support arm having first and second ends, the support arm comprising a first link having first and second ends, the first end of the first link coupled to the base at a first location so as to be capable of rotation about the base and so as to be capable of displacement relative to the base; (c) a support member for supporting the object, the support member coupled to the second end of the support arm; (d) an engageable and disengageable mechanism for locking rotation of the support arm about the base in at least a first direction, comprising: (i) first and second contact members formed on one of the base or the first end of the first link, the first and second contact members spaced apart by a distance and defining a line extending therethrough, (ii) at least a segment of a ring formed on the other of the base or the first end of the first link, the ring segment having inner and outer arcuate surfaces, the ring segment having a radius of curvature that defines a center thereof, the ring segment disposed between the first and second contact members, wherein, when the center of the ring segment radius of curvature is displaced a first distance from the line extending through the first and second contact members, application of a load on the support member causes the first contact member to impart a force on the ring segment inner surface and causes the second contact member to impart a force on the ring segment outer surface, the forces generating a friction force that restrains rotation of the first link in the first direction, whereby the locking mechanism is engaged and the support arm is restrained from rotation in the first direction, and wherein, when the first link and the base undergo relative displacement so that the center of the ring segment radius of curvature is displaced a second distance from the line that is less than the first distance, application of a load on the support member does not cause the first and second contact members to exert forces on the ring segment inner and outer surfaces, respectively, that generate friction forces that restrain rotation of the first link in the first direction, whereby the locking mechanism is disengaged and the support arm can be rotated in the first direction.

The current invention also encompasses a method of engaging and disengaging a locking mechanism in a support apparatus for supporting an object thereon that can be adjusted by a user. The support apparatus comprises: (i) a base, (ii) a rotatable support arm capable of rotation relative to the base over at least a range of angular orientations, the support arm having first and second ends, the first end of the support arm coupled to the base so as to be capable of rotation about the base, at least a portion of the support arm coupled to the base so as to be capable of translation relative to the base, (iii) a support member for supporting the object, the support member coupled to the second end of the support arm, and (iv) an engageable and disengageable mechanism for locking downward rotation of the support arm about the base comprising (A) first and second contact members projecting from one of the base or the translatable portion of the support arm, the first and second contact members spaced apart by a distance, and (B) at least a segment of a ring formed on the other of the base or the translatable portion of the support arm, the ring segment having inner and outer arcuate surfaces and disposed between the first and second contact members. The method of engaging and disengaging the locking mechanism so as to restrain downward rotation of the support arm about the base comprises:

(a) engaging the locking mechanism by translating the translatable portion of the support arm in a first direction so as to cause the first contact member to contact the inner surface of the ring segment and the second contact member to contact the outer surface of the ring segment; and (b) disengaging the locking mechanism by translating the translatable portion of the support arm in a second direction opposite from the first direction.

BRIEF DESCRIPTION OF THE DRAWINGS

FIGS. 15(*a*) and (*b*) are schematic diagrams of a mechanism for preventing downward rotation of a straight member.

FIGS. 16(*a*) and (*b*) are schematic diagrams illustrating the restraining of downward rotation of ring segment according to the current invention.

FIGS. 18(*a*) and (*b*) show enlarged portions of FIGS. 17(*a*) and (*b*), with the stop pin shown.

FIGS. 19 and 20 show an alternate embodiment of the base and support arm link, respectively.

DESCRIPTION OF THE PREFERRED EMBODIMENT

Figure 1:
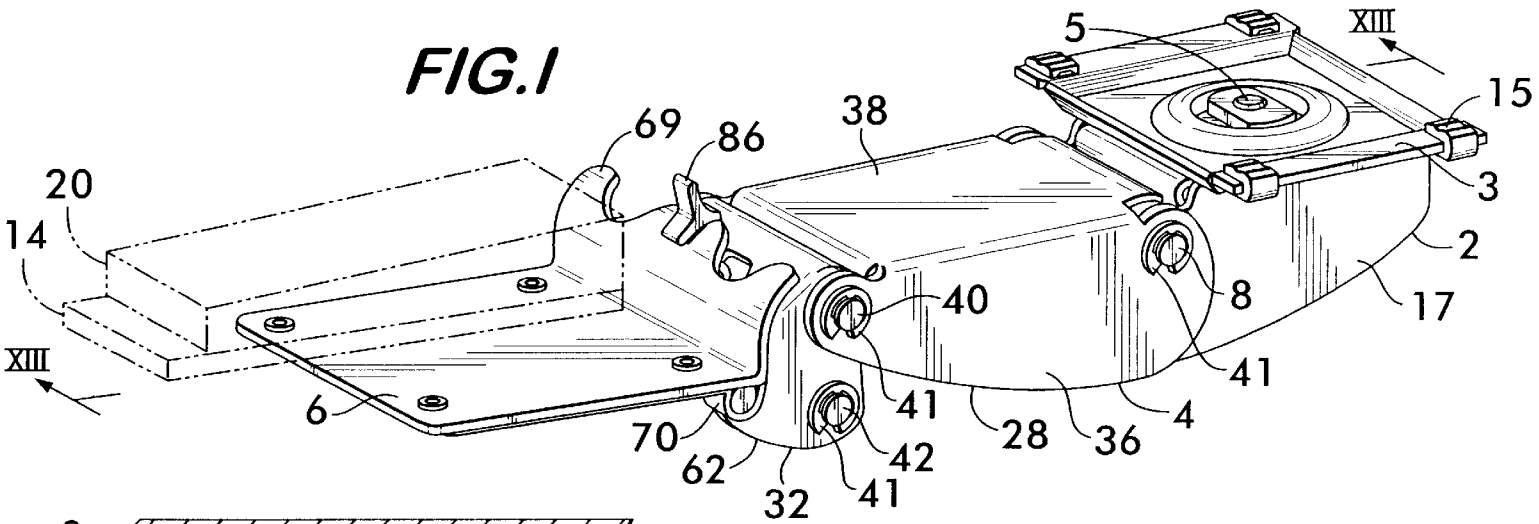
FIG. 1 is an isometric view of an adjustable keyboard support apparatus according to the current invention.
Figure 2:
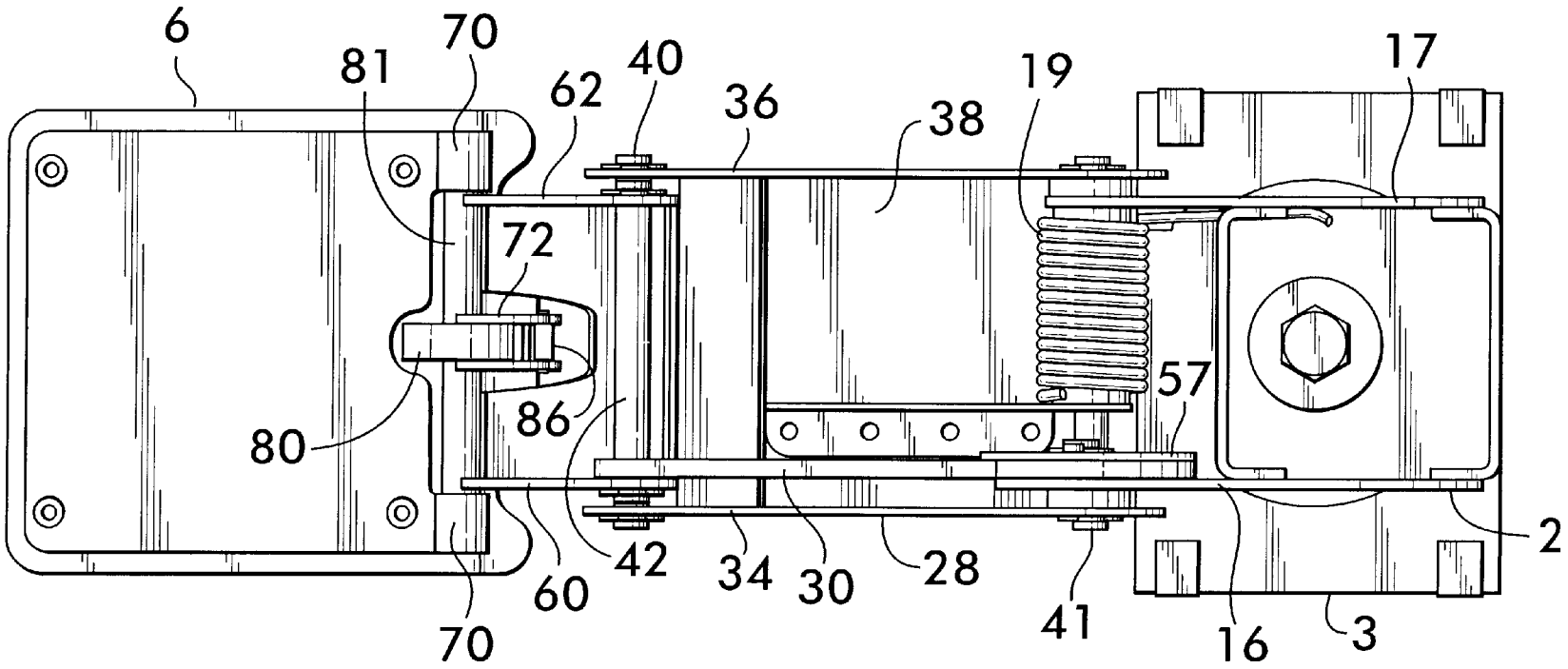
FIG. 2 is a view of the keyboard support apparatus shown in FIG. 1 from below.
Figure 4:
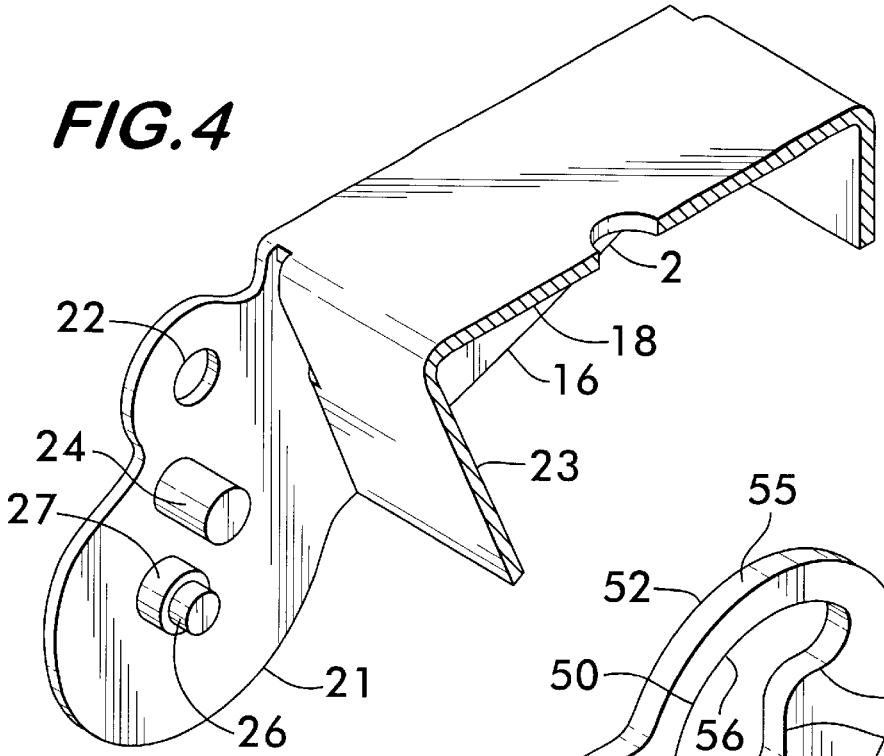
FIG. 4 is an isometric view of a longitudinal cross-section through the base portion of the apparatus.

An adjustable support apparatus according to the current invention is shown generally in FIGS. 1 and 2. The apparatus comprises a base 2, to which a support arm 4 is rotatably mounted, and a support member 6 rotatably mounted on the support arm. If the apparatus is used to support a keyboard 20, a keyboard support 14 is attached via screws to the support member 6. The keyboard support 14 is formed from a rigid sheet, preferably, a composite sheet formed by bonding a thin sheet of aluminum to a thermoplastic core. Suitable composite sheets are available from Alusuisse Composites, Inc., of Benton, KY., under the trade name Alucobond™. Keyboard supports could also be formed from medium density fiberboard (MDF), steel, or other rigid material. The keyboard support 14 has a non-slippery work surface that is adapted to retain the keyboard 20. As is well known in the art, various types of brackets and clamps could also be attached to the keyboard support 14 to aid in retention of the keyboard 20. Alternatively, as those skilled in the art will readily appreciate, if the apparatus were used to support a monitor or other device, the configuration of the support member 6 could be altered accordingly, for example by replacing the plate-like portions of the support member 6 with a bracket so as to form a bracket type support member.

Figure 3:
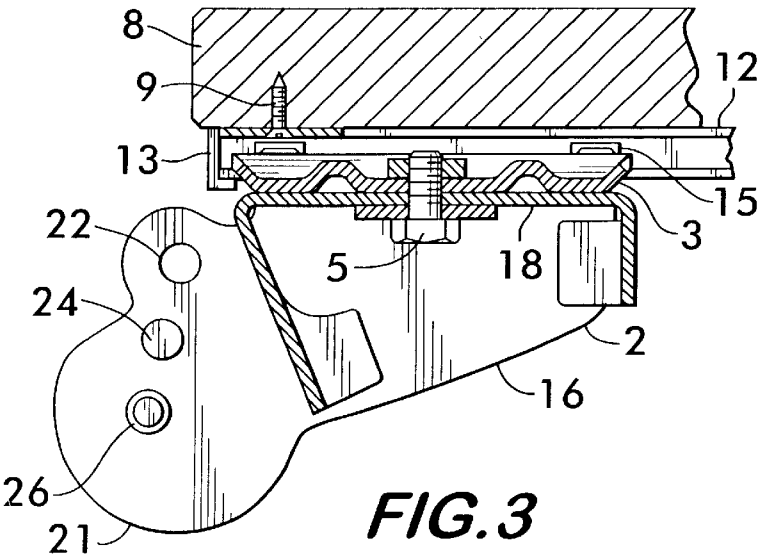
FIG. 3 is a longitudinal cross-section through the base portion of the keyboard support, showing the base attached to the underside of a desk top.

As shown in FIG. 3, the top plate 18 of the base 2 is rotatably attached to a trolley 3 by means of a screw 5. Rotation of the base 2 on the trolley 3 allows the support arm 4 and support member 6 to be rotated within a horizontal plane. The trolley 3 is slidably retained on plastic glides 15 within a track 12 that is attached to the underside of a desk surface 8 by means of screws 9. A stop 13 prevents the trolley 3 from sliding out of the track 12. This arrangement allows the base 2 to be slid under the desk 8 and rotated out of the way when the apparatus is not in use. Other methods of mounting the base 2 to a structure, which are well known in the art, could also be utilized.

As also shown in FIGS. 1–4, the base 2 is an approximately U-shaped member having opposing left and right side walls 16 and 17 and a forward wall 23 each of which extend downwardly from the top plate 18. The walls 16 and 17 are of similar shape except that wall 16 has an enlarged section 21 at its front lower corner. Aligned holes 22 are formed near the front upper corner of each side wall 16 and 17. A pin 24, which is displaced below the hole 22, projects horizontally from the inner surface of the side wall 16 toward the side wall 17. A stop pin 26, which includes a plastic bushing 27, is displaced from the pin 24 and projects horizontally from the inner surface of the side wall 16 toward the side wall 17.

Figure 5:
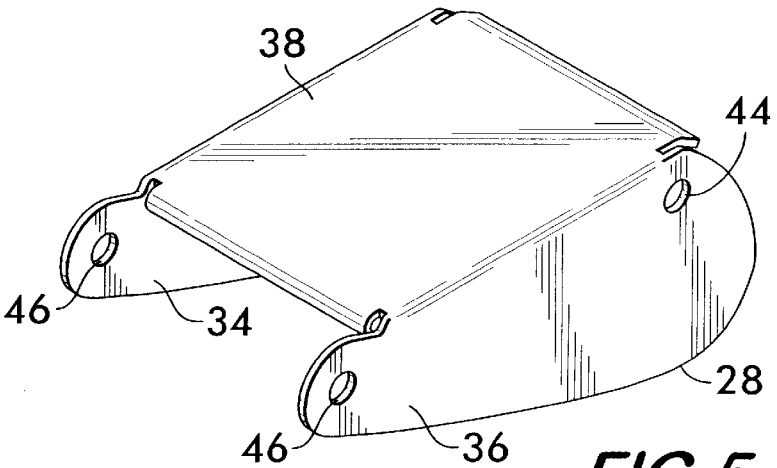
FIG. 5 is an isometric view of the cover portion of the support arm.
Figure 12A:
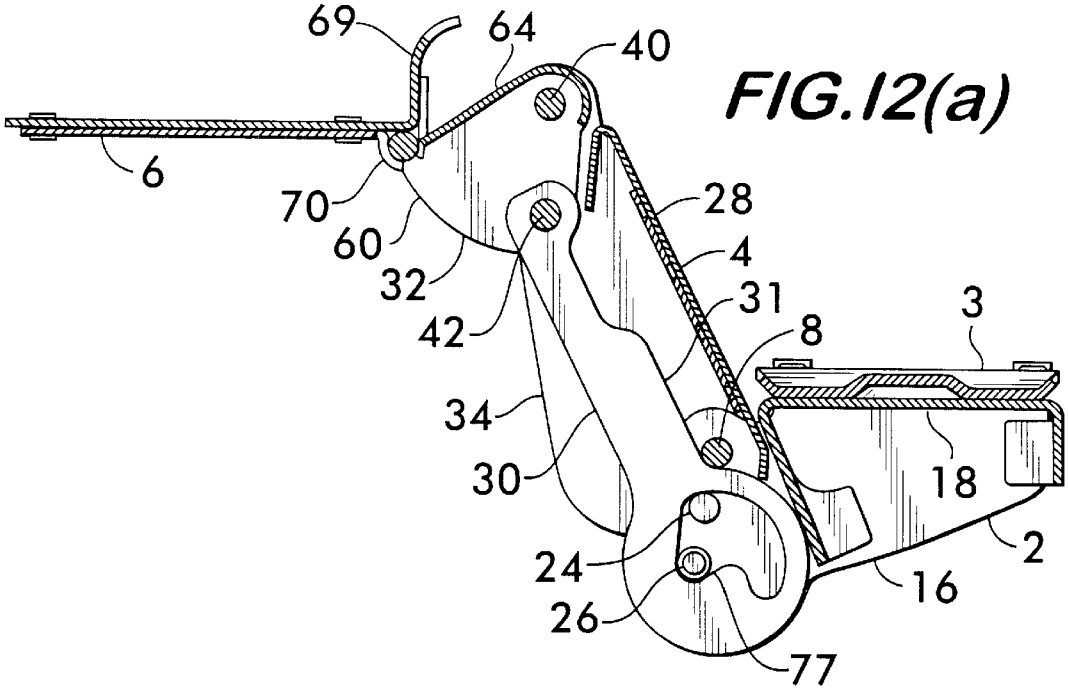
FIGS. 12(*a*) and (*b*) show longitudinal cross-sections of the keyboard support with the support arm rotated in the raised and lowered positions, respectively, with the restraining mechanism cover plate removed for clarity.
Figure 12B:
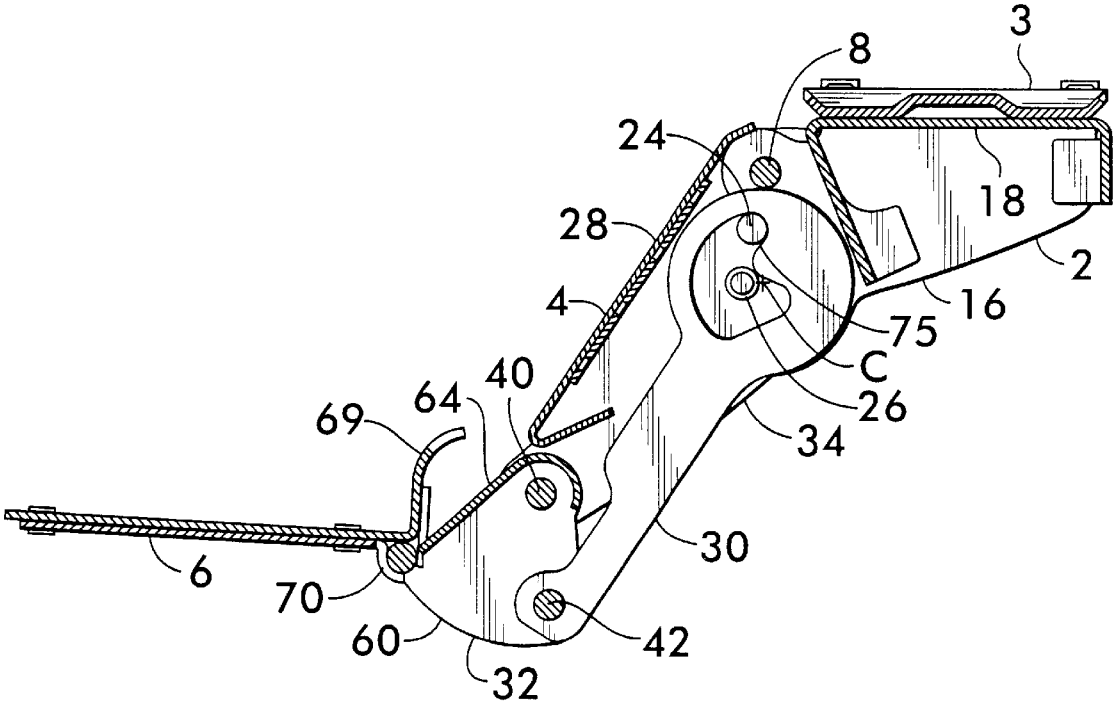
Figure 13:
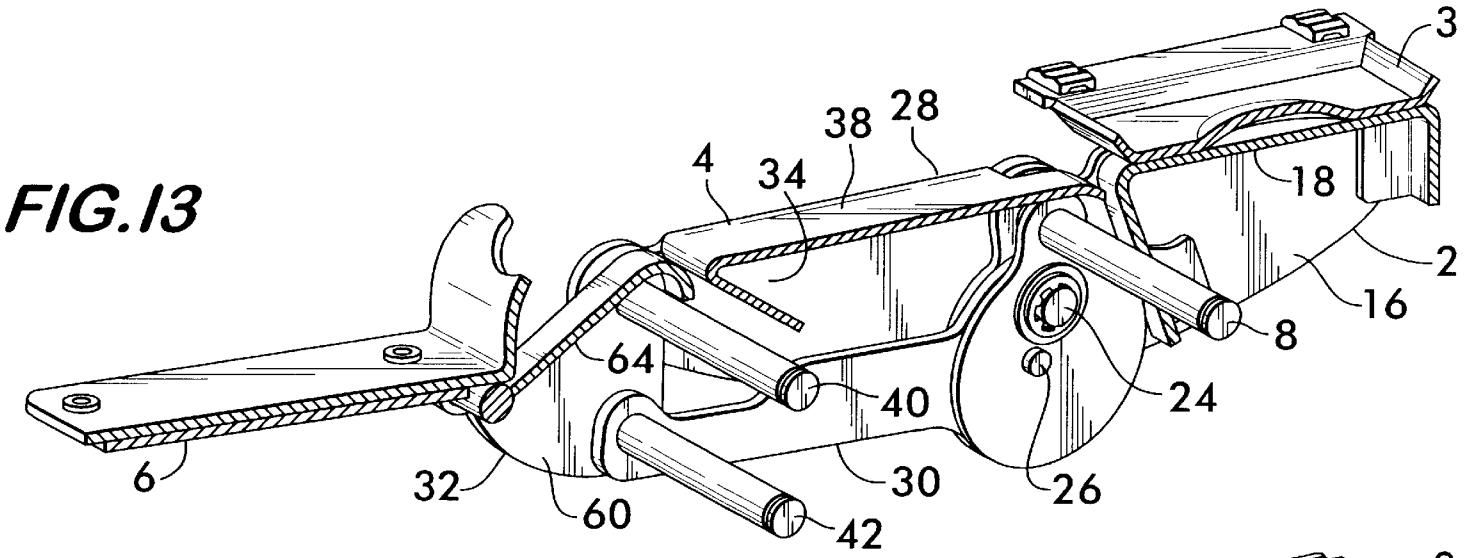
FIG. 13 is a longitudinal cross-section taken along line XIII—XIII shown in FIG. 1.
Figure 14:
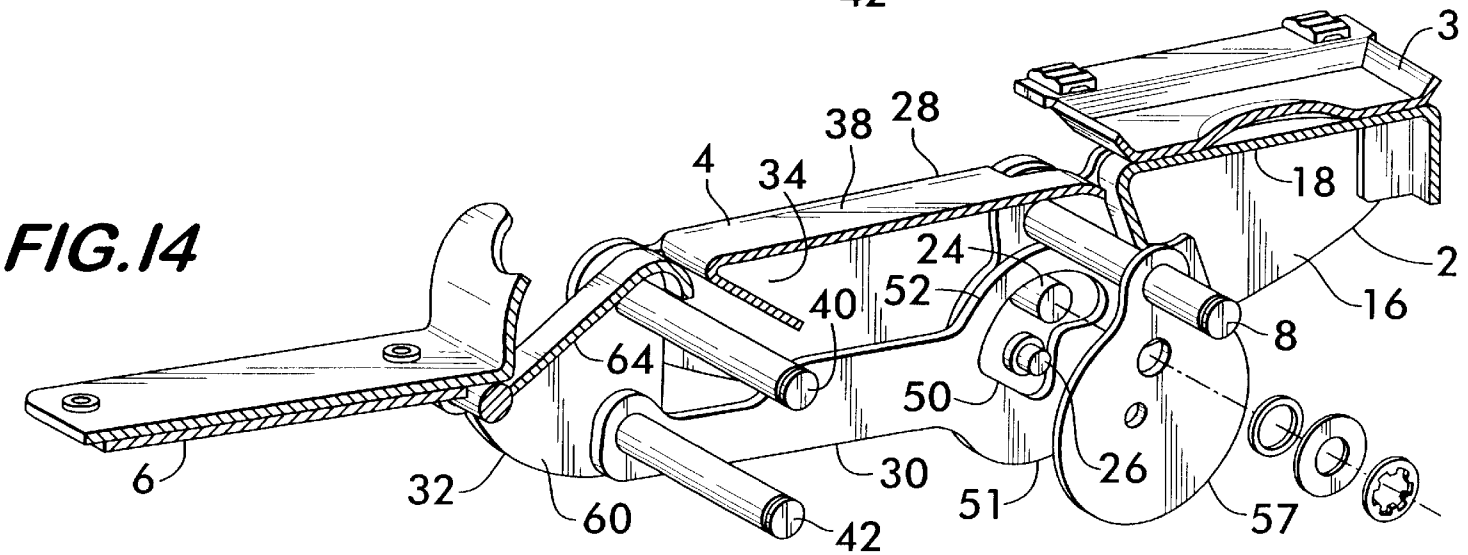
FIG. 14 is a view similar to FIG. 13 but with an exploded view of the mechanism for restraining downward rotation of the support arm.

As shown best in FIGS. 13 and 14, the support arm 4 is comprised of a cover 28, a link 30 and a connector 32. As shown best in FIG. 5, the cover 28 is an approximately U-shaped member having opposing left and right side walls 34 and 36 that extend downwardly from a top plate 38. Aligned holes 46 are formed near the front of each of the side walls 34 and 36 that support a shaft 40. Aligned holes 44 are formed near the rear upper corner of each of the side walls 34 and 36 that support a second shaft 8. The shaft 8 also extends through the holes 22 in the side walls 16 and 17 of the base 2 so as to rotatably couple the cover 28 to the base. As shown in FIGS. 12(*a*) and (*b*), as a result of this coupling arrangement, the support arm 4 is capable of rotating about the base 2 throughout a range of angular orientations, from a raised orientation shown in FIG. 12(*a*) to a lowered orientation shown in FIG. 12(*b*). Preferably, the range of angular orientations is approximately 120°. The rotation of the support arm 4 allows the height of the support member 6 to be adjusted.

As shown in FIG. 2, a torsion spring 19 is mounted on the shaft 8. One end of the torsion spring 19 is supported on the base 2 and the other end on the cover 28, so that the spring generates a force tending to rotate the support arm 4 upward. This forces offsets the load on the support member 6, such as from a keyboard, making it easier to rotate the support arm upward. Alternatively, a gas-filled cylinder, connected between the base 2 and support arm 4, could be used to supply such a force to the arm. Such cylinders are typically filled with nitrogen and have two chambers so as to maintain the force exerted by the piston substantially constant. Suitable constant force gas filled cylinders are available from Stabilus, 1201 Tulip Drive, Gastonia, N.C. 28052. In yet another embodiment, a constant force spring, such as that disclosed in the aforementioned U.S. Pat. No. 6,227,508 could be utilized to apply an upward force to the support arm 4.

Figure 6:
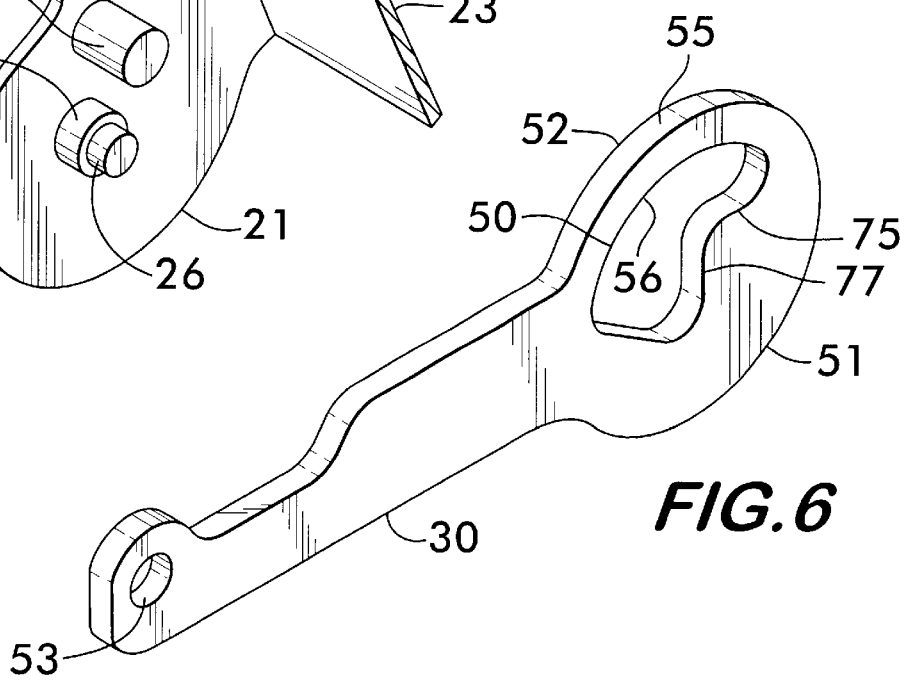
FIG. 6 is an isometric view of the link of the support arm.

As shown best in FIGS. 2 and 14, the link 30 extends along the length of the support arm 4 essentially parallel to the side wall 34 of the cover 28. A shaft 42 is rotatably mounted in a hole 53 in the front end of the link 30. As shown best in FIG. 6, the link 30 forms a circular plate 51 at its rear end. A window 50 is formed in the plate portion 51. The window 50 forms a segment of a ring 52 in the top portion of the plate portion 51. When the link 30 is installed in the support arm 4, the ring segment 52 is located between the shaft 8 and the pin 24, with the pin 24 and the stop 26 projecting through the window 50. This allows the ring segment 52 to rotate within the gap formed between the pin 24 and the shaft 8, as discussed further below. Thus, the link 30 is capable of both rotation and translation (within a limited range) relative to the base 2. A cover plate 57 is mounted on the shaft 8 that covers the circular plate portion 51 of the link 30 and retains the link.

Figure 7:
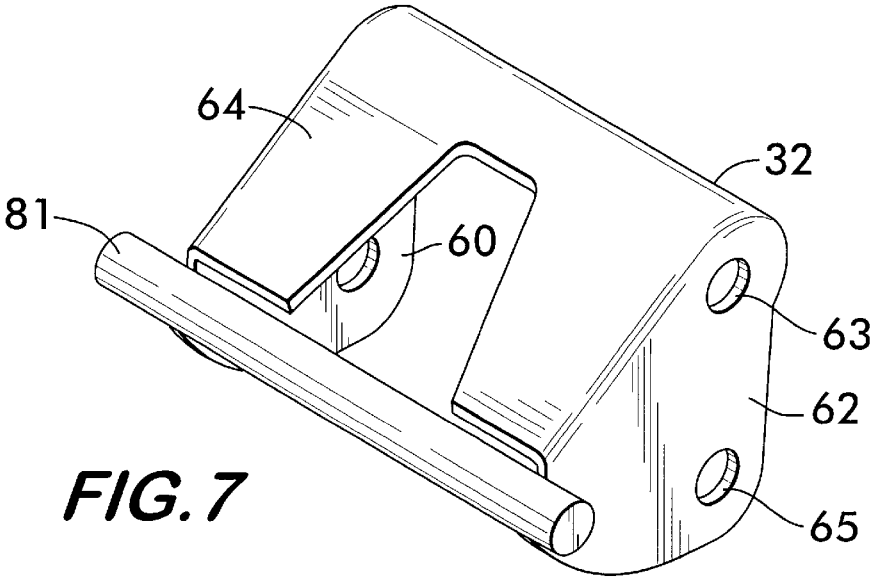
FIG. 7 is an isometric view of the connector portion of the support arm, without the ratchet.
Figure 8:
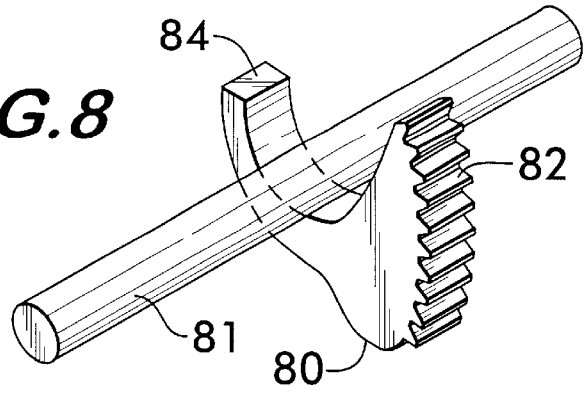
FIG. 8 is an isometric view of the ratchet mechanism for locking the orientation of keyboard support member.

The connector 32 is located at the front end of the support arm 4. As shown best in FIG. 7, the connector is comprised of left and right side walls 60 and 62 that extend downwardly from a top plate 64. Aligned holes 63 are formed in the upper rear corner of the side walls 60 and 62. Similarly, aligned holes 65 are formed in the lower rear corner of the side walls 60 and 62. A shaft 81 is fixed to the front of the connector 32. As shown in FIG. 8, a ratchet 80 is affixed to the connector shaft 81. The ratchet 80 has teeth 82 on its forward face. The rear end of the ratchet 80 forms a stop 84.

The shaft 40 is rotatably mounted in upper holes 63 in the connector side walls 60 and 62, thereby allowing the connector 32 to rotate relative to the support arm cover 28. Similarly, the shaft 42, on which the front end of the link 30 is mounted, is rotatably mounted in the lower holes 65 in the connector walls 60 and 62, thereby allowing the connector 32 to rotate relative to the support arm link 30, as shown in FIGS. 12(*a*) and (*b*). Locking clips 41 ensure that the shafts 8, 40 and 42 are retained.

Figure 9:
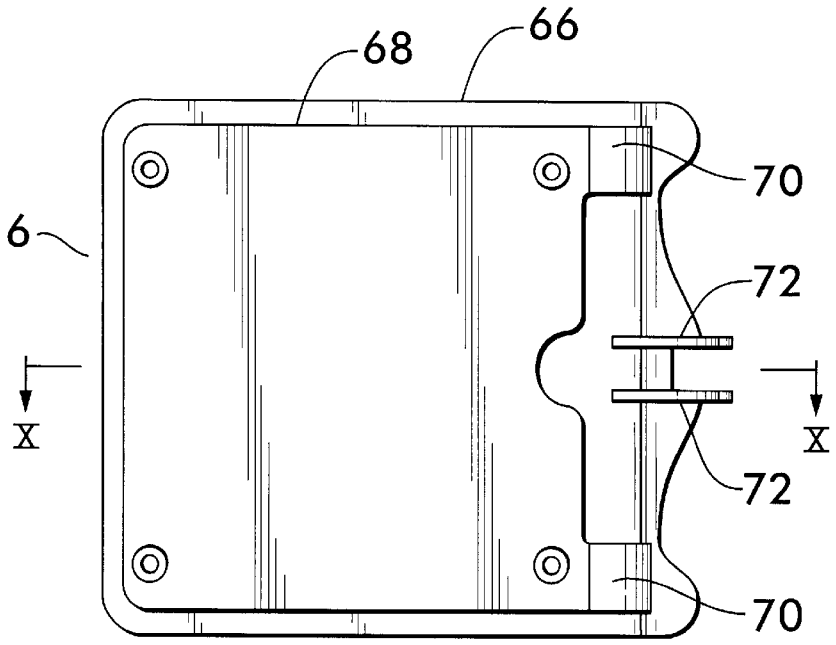
FIG. 9 is a view of the keyboard support member from below.
Figure 10:
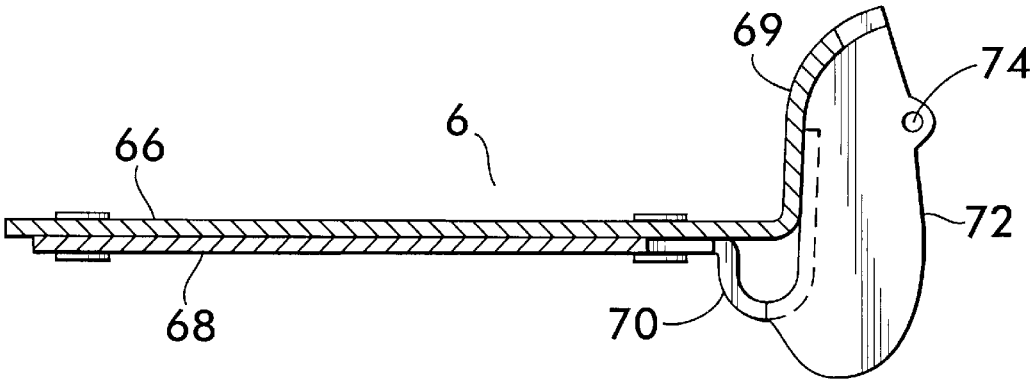
FIG. 10 is a cross-section taken through line X—X shown in FIG. 5.
Figure 11A:
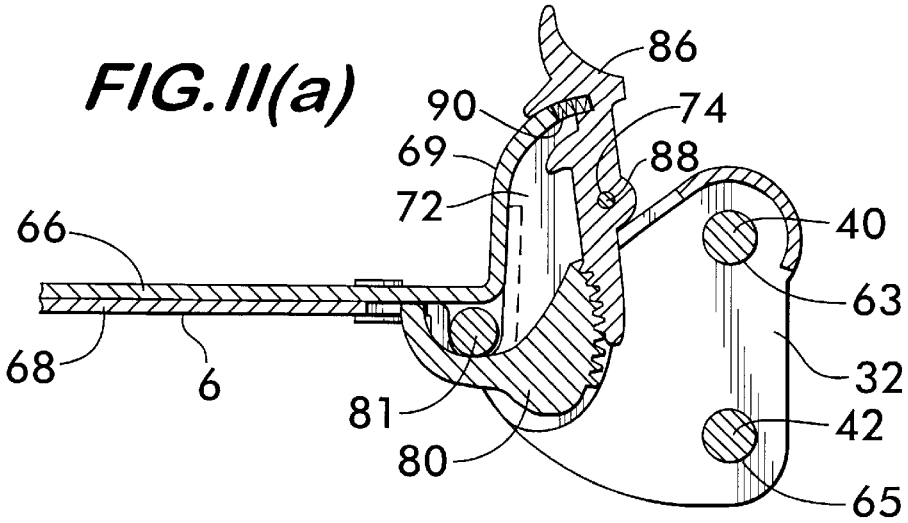
FIGS. 11(*a*), (*b*) and (*c*) show, respectively, the keyboard support member locked into the horizontal orientation by the ratchet and pawl mechanism, the unlocking of the ratchet and pawl mechanism in preparation for rotating the support mechanism, and the keyboard support member locked into an upward inclined orientation.
Figure 11B:
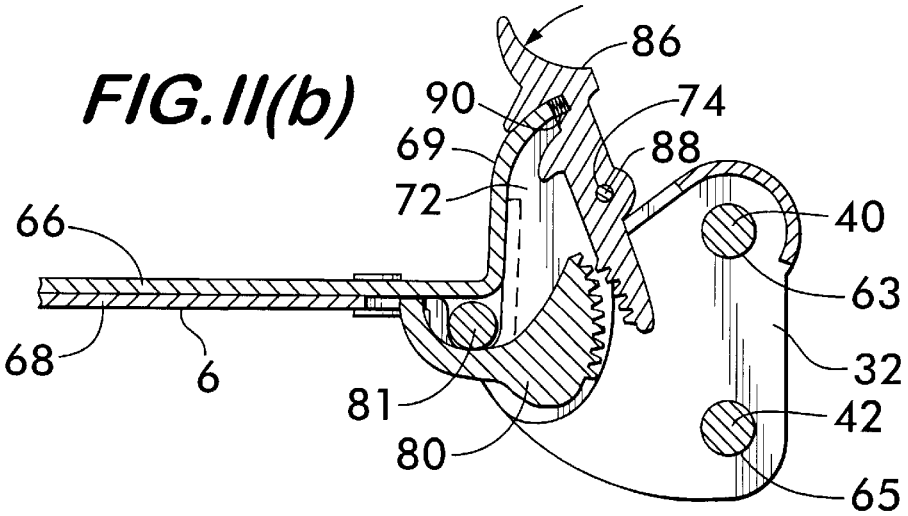
Figure 11C:
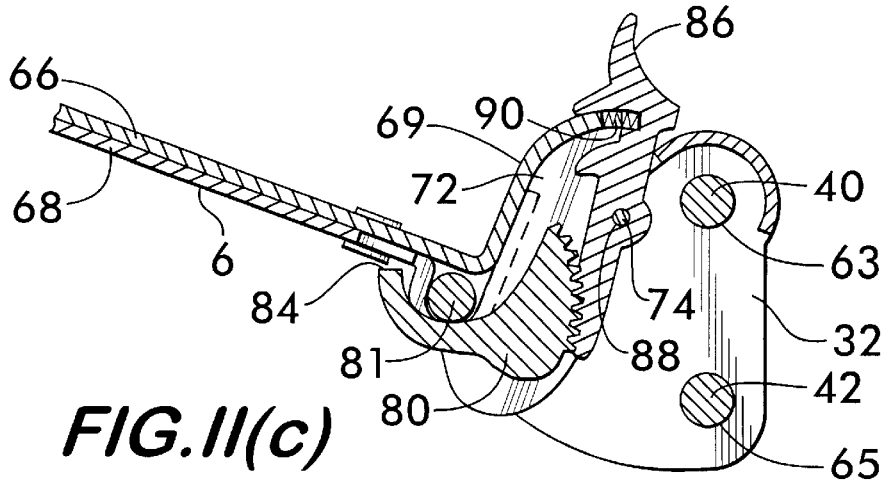

As shown best in FIGS. 9 and 10, the support member 6 comprises joined upper and lower plates 66 and 68, respectively. An approximately vertically extending wall 69 is formed at the rear of the upper plate 66. The lower plate forms collars 70 on either side of the support member 6. The connector shaft 81 is rotatably mounted in the collars 70 so that the support member 6 can rotate with respect to the connector 38, as shown in FIGS. 11(*a*) to (*c*). This allows the angular orientation, or inclination, of the support member to be adjusted, as discussed further below. A pair of plates 72 extend rearwardly from the rear wall 69 of the support member 6. Aligned holes 74 are formed in projections formed in the rear edge of each plate 72.

As shown best in FIGS. 11(*a*)–(*c*), a pawl 86 is rotatably mounted on a shaft 88 between the plates 72 that extend from the support member rear wall 69. The shaft 88 is supported in the holes 74 in the plates 72. The pawl 86 has teeth that are adapted to engage the teeth 82 on the ratchet 80. A compression spring 90 is disposed between support member rear wall 69 and the pawl 86 so as to bias the pawl teeth into engagement with the ratchet teeth 82—that is, the spring causes the pawl 86 to pivot about the shaft 88 in the clockwise direction, as shown in FIG. 11. (It should be realized that the terms "clockwise" and "counterclockwise" as used herein are intended to refer only to directions that are opposing and that rotation that appears clockwise when the apparatus is viewed from one side will appear counterclockwise when viewed from the opposite side.) Engagement of ratchet 80, which is supported on the connector 32, with the pawl 86, which is supported on the support member 6, locks in the inclination of the support member 6 relative to the connector.

The mechanism for locking the inclination of the support member 6 will now be discussed. As shown in FIG. 11(*a*), the support member 6 is locked by the ratchet and pawl mechanism into the horizontal orientation. As shown in FIG. 11(*b*), this locking mechanism is released by pressing on the end of the pawl 86, thereby compressing the spring 90 and causing the pawl to pivot about shaft 88 in the counterclockwise direction so as to become disengaged from the ratchet 80. With the locking mechanism disengaged, the inclination of the support member 6 can be readily adjusted by rotating it about connector shaft 81. The stop 84 on the ratchet 80 limits the downward inclination of the support member 6 by contacting the underside of the plate 68—for example, the minimum downward inclination could be set at horizontal, as shown in FIG. 11. After the desired inclination is obtained, the pawl 86 is released so that the compression spring 90 once again biases the pawl into engagement with the ratchet 80, thereby locking the support member into the new inclination, as shown in FIG. 11(*c*).

The mechanism for locking the angular orientation of the support arm 4, and therefore the height of the support member 6, will now be discussed. As shown in FIG. 15(*a*), a beam B is placed between two pins, or contact members, $P_1$ and $P_2$ so that there is a clearance CL between the beam and the pins—that is, the thickness of the beam is less than the distance between the pins. In this situation, application of a load W on the beam will cause it to rotate counterclockwise until the lower surface of the beam contacts the lower pin $P_2$ and the upper surface of the beam contacts the upper pin $P_1$, thereby preventing further downward rotation of the beam. The angular orientation of the beam at which rotation is arrested depends on the clearance CL—the larger the clearance, the greater the angle of orientation of the beam when its rotation is arrested. Moreover, the contact between the beam and the pins generate forces $N_1$ and $N_2$ on the beam that, in turn, generate frictional resistance that can restrain the beam from sliding downward. While the beam and pin arrangement shown in FIG. 15 can be used to maintain the beam in a particular angular orientation, the orientation is function of the geometry of the components and cannot be adjusted without modification of the components.

FIGS. 16(*a*) and (*b*) show a ring segment R placed between upper and lower pins, or contact members, $P_1$ and $P_2$. The ring segment has a semi-circular inner surface of radius of curvature $r_i$ and a semi-circular outer surface of radius of curvature $r_o$. These radii of curvature define a common center C and their difference defines the thickness of the ring segment. As shown in FIG. 16(*a*), the ring segment is located so that the center C of the radii of curvature is aligned with a line L extending through the centers of the pins. The thickness of the ring segment is less than the distance between the pins so as to create a clearance CL. Provided that the ring segment is caused to remain centered approximately on line L, the ring segment is free to rotate. In this configuration, a load W applied to a member M extending from the ring would cause the ring to rotate in the counterclockwise direction without restraint.

FIG. 16(*b*) shows a configuration in which the ring segment has been translated to the right so that its center C has been displaced a distance d from line L that is sufficient to cause the outer surface of the ring to contact the upper pin and the upper surface of the ring to contact the lower pin (note that the ring segment has also been displaced upward slightly). This contact will cause the upper and lower pins to exert forces $N_1$ and $N_2$ on the outer and inner surfaces of the ring that, in turn, will generate frictional resistance $F_1$ and $F_2$, respectively, that restrain the counterclockwise rotation of the ring segment. The greater the frictional forces, the greater the load W necessary to overcome the restraint and cause the ring to rotate. Also, the greater the clearance CL between the ring segment and the pins, and the smaller the radius of curvature of the ring segment, the greater the displacement d necessary to effect locking.

Unlike the situation with the beam previously discussed in connection with FIG. 15, due to its curvature, the ring segment can be locked in any given angular orientation. For example, in the unconstrained state shown in FIG. 16(*a*), the ring could be rotated into the position shown in phantom, and then locked in place by displacing the ring segment as shown in FIG. 16(*b*).

Figure 17A:
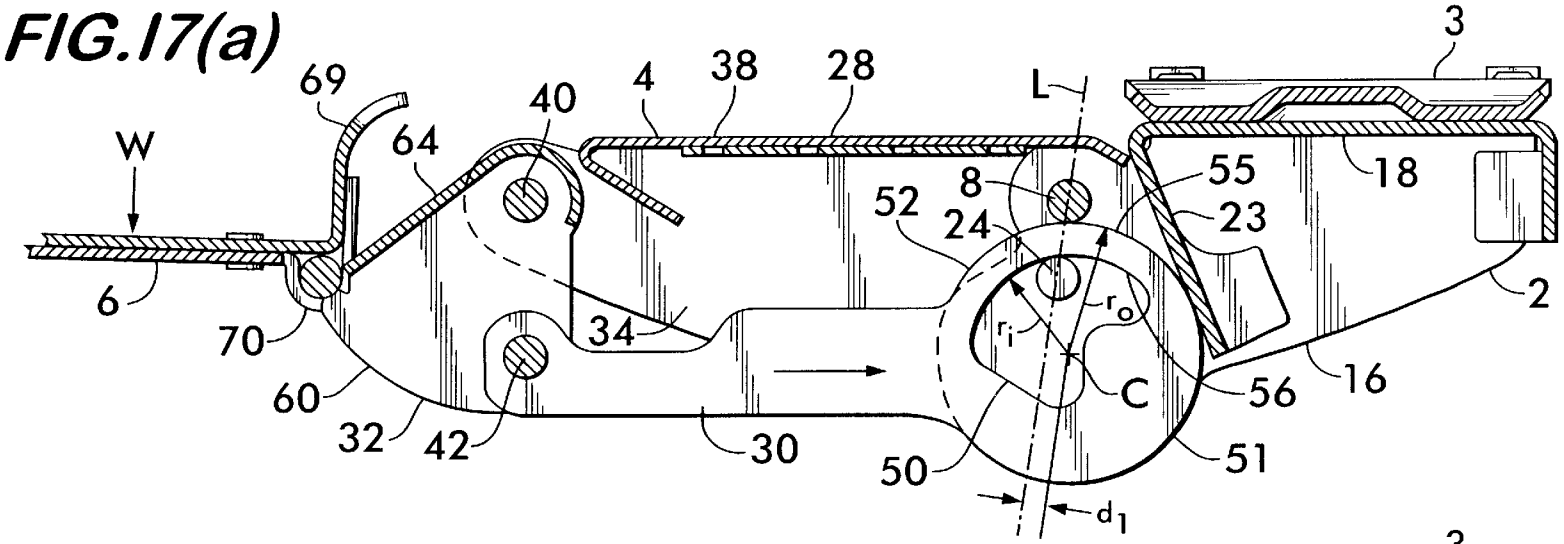
FIGS. 17(*a*) and (*b*) show longitudinal cross-sections of the keyboard support apparatus, with the restraining mechanism cover plate and the stop pin removed for clarity, showing, respectively, the support arm link in the position in which the rotation restraining mechanism is engaged and the support arm link after displacement into a position in which the rotation restraining mechanism is disengaged.
Figure 17B:
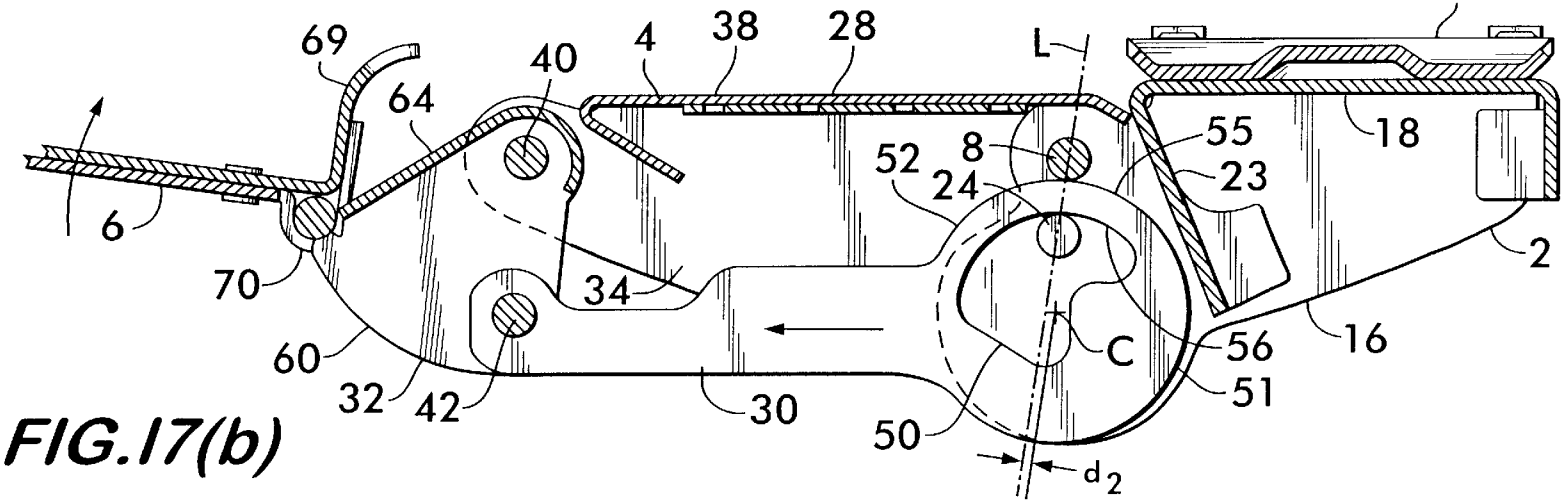

FIGS. 17(*a*) and (*b*) illustrate the operation of the mechanism for locking the support arm 4 in place—that is, restraining it from rotating downward when load is applied to the support member 6—and then unlocking it when it is desired to adjust the height of the support member 6, using the principles discussed above. As previously discussed, the rear end of the support arm link 30 forms a circular plate 51. The window 50 in the plate 51 forms a ring segment 52 that is disposed between two pins, or contact members—the upper pin being the shaft 8 that couples the support arm cover 28 to the base 2 and the lower pin being the pin 24 extending from the side wall 16 of the base 2.

When the support arm 4 is in the locked state, as shown in FIG. 17(*a*), the load W applied to the support member 6 causes a moment to be applied to the connector 32, tending to rotate it counterclockwise (when viewed as in the figure) about the shaft 40. The moment on the connector 32 creates a force that drives the link 30 to the right—that is, rearward. With the link 30 in this position, the center C of the radius of curvature of the ring 52—in this case, the common radii of curvature of the inner and outer ring surfaces—is displaced by a distance $d_1$ from a line L extending through the centers of the shaft 8 and pin 24. The components are dimensioned so that the clearance CL—that is, the difference between the distance between the shaft 8 and pin 24 and the thickness of the ring 52—is such that the displacement $d_1$ is sufficient to cause the ring outer surface 55 to contact the shaft 8 and the ring inner surface 56 to contact the pin 24. Note that there is at least a small clearance between the rear surface of circular plate 51 of the link 30 and the forward wall 23 of the base 2 so that contact between the circular plate and the forward wall does restrict the rearward movement of the link 30, as shown in FIG. 18(*a*).

As previously discussed, in this configuration, the load W on the support member 6, which tends to rotate the link 30 downward, causes the pin 24 and shaft 8 to impart forces to the inner and outer ring surfaces 56 and 55, respectively. These forces generate frictional forces that resist the rotation of the ring 52 relative to the shaft 8 and pin 24 and, therefore, resist rotation of the link 30 about the base 2. When the link 30 is prevented from downward rotation about the base 2, the support arm 4 is similarly prevented from downward rotation about the base. Thus, the support arm 4 is able to resist the load W and remains "locked" in the horizontal angular orientation as shown in FIG. 17(*a*). The maximum load W on the support member 6 that the support arm locking mechanism can withstand will depend on the coefficient of friction of the mating surface of the shaft 8, pin 24, and ring segment 52—the higher the coefficient of friction, the greater the frictional resistance and the greater the load that can be withstood. Preferably, the static coefficient of friction between the ring segments and the shaft 8 and pin 24 is at least 0.2 and, more preferably, at least 0.7. In one preferred embodiment of the invention, the shaft 8, pin 24, and ring segment 52 are made of mild steel and have a static coefficient of friction of about 0.74.

When it is desired to "unlock" the support arm 4, the user merely applies a force that tilts the support member 6 upward, as shown in FIG. 17(*b*). Since the ratchet 80 and pawl 86 mechanism discussed above remains engaged and prevents relative rotation between the support member 6 and the connector 32, this upward tilting causes the connector 32 to rotate counterclockwise about shaft 40, as shown in the figure, thereby translating the link 30 to the left—that is, forward—relative to the base 2 and the remainder of the support arm 4. This translation reduces the distance $d_2$ by which the center C of the ring segment 52 is displaced from the line L sufficiently to unlock the mechanism. Preferably, the distance $d_2$ is essentially zero, so that the shaft 8 and pin 24 create essentially no frictional resistance to rotation of the ring segment 52. However, it is only necessary that the distance $d_2$ be sufficiently small that the surfaces of the ring segment either no longer bear against the shaft 8 and pin 24 or do not bear with sufficient force to provide objectionable resistance to repositioning the support arm 4. The stop pin 26 limits the forward travel of the link 30 by contacting the surface 77 of the window 50, as shown in FIG. 18(*b*). This ensures that the center point C is not displaced past—that is, to the left of—the line L, which could lock the arm 4 from rotating upward.

The nominal design value for the clearance CL should be set sufficiently large to ensure that manufacturing tolerances do not prohibit the ring segment 52 from fitting between the shaft 8 and pin 24 but otherwise should be as small as possible. In general, the larger the radius of curvature of the ring segment 52, the larger the clearance CL that can be tolerated and still achieve locking. In one embodiment of the invention, the distance between the shaft 8 and pin 24 is 0.302 inch and the thickness of the ring segment 52 is 0.282 inch, so that the clearance is about 0.20 inch. In addition, and the radius of curvature of the ring segment outer surface 55 is about 1.25 inch.

With the support member 6 titled as shown in FIG. 17(*b*), the support arm 4 can be freely rotated downward so as to place the support member at the desired height. Thus, by maintaining tilt on the support member, the user effectively guides the link 30 during downward rotation of the support arm so that the ring segment center C is maintained sufficiently close to the line L to prevent the pins from restraining the rotation of the ring segment.

When the desired height is obtained, the locking mechanism is re-engaged by tilting the support member 6 back down, as shown in FIG. 17(*a*). Note that locking and unlocking can be achieved with the support arm 4 in any angular orientation, as shown in FIGS. 12(*a*) and (*b*). Also note that the mechanism provides no restraint to the upward rotation of the support arm.

The pins 24 and shaft 8 create stops that limits the rotation of the support arm 4. As shown best in FIG. 6, the window 50 forms a surface 75.0 When the support arm 4 is rotated upward, the shaft 8 eventually contacts the upper surface 31 of the link 30, thereby preventing further upward rotation, as shown in FIG. 12(*a*). When the support arm 4 is rotated downward, the pin 24 eventually contacts surface 75, thereby preventing further downward rotation, as shown in FIG. 12(*b*).

Although in the preferred embodiment, the pin 24 and shaft 8 are supported on the base 2 and ring segment 52 is formed on the link 30, as shown in FIGS. 19 and 20, the invention could also be practiced with pins 8' and 24' formed on support arm link 30' and the ring segment 52' formed on the inner surface of the side wall 16'.

In the preferred embodiment, the cover 28, link 30, and connector 32 of the support arm, together with the forward portion of the base 2, each form one link of a four bar linkage. When the support arm 4 is in the locked position, this four bar linkage forms a parallel bar linkage—that is, the distance between the centerline of shafts 40 and 42 equals the distance between the centerline of shaft 8 and center point C, and the distance between the centerline of shafts 8 and 40 equals the distance between the centerline of shaft 42 and center point C. Of course, when the link 30 is pulled forward so as to unlock the support arm 4, the distance between the centerline of shaft 8 and center point C increases and no longer equals the distance between the center lines of shafts 40 and 42, so that parallelism is lost. Forming the parallel four bar linkage ensures that, when the link 30 is in its locked orientation, the angular orientation of the connector 32—and therefore the inclination of the support member 6 that is fixed to it—remains essentially constant over a range of angular orientations of the support arm 4, as shown in FIGS. as 12(*a*) and (*b*). Thus, resetting of the inclination of the support member 6 is not required when its height is adjusted by means of varying angular orientation of the support arm 4.

Although the present invention has been illustrated with reference to a keyboard support, the invention is equally applicable to other apparatus for supporting an object in a manner that provides for ready adjustment. Thus, the present invention may be embodied in other specific forms without departing from the spirit or essential attributes thereof and, accordingly, reference should be made to the appended claims, rather than to the foregoing specification, as indicating the scope of the invention.

What is claimed:

1. An adjustable support apparatus for supporting an object thereon that can be adjusted by a user, comprising:

(a) a base;

(b) a rotatable support arm capable of rotation relative to said base over at least a range of angular orientations, said support arm having first and second ends, said support arm comprising a first link having first and second ends, said first end of said first link coupled to said base at a first location so as to be capable of rotation about said base and so as to be capable of displacement relative to said base;

(c) a support member for supporting said object, said support member coupled to said second end of said support arm;

(d) an engageable and disengageable mechanism for locking rotation of said support arm about said base in at least a first direction, comprising:

(i) first and second contact members formed on one of said base or said first end of said first link, said first and second contact members spaced apart by a distance and defining a line extending therethrough, (ii) at least a segment of a ring formed on the other of said base or said first end of said first link, said ring segment having inner and outer arcuate surfaces, said ring segment having a radius of curvature that defines a center thereof, said ring segment disposed between said first and second contact members, wherein, when said center of said ring segment radius of curvature is displaced a first distance from said line extending through said first and second contact members, application of a load on said support member causes said first contact member to impart a force on said ring segment inner surface and causes said second contact member to impart a force on said ring segment outer surface, said forces generating a friction force that restrains rotation of said first link in said first direction, whereby said locking mechanism is engaged and said support arm is restrained from rotation in said first direction, and wherein, when said first link and said base undergo relative displacement so that said center of said ring segment radius of curvature is displaced a second distance from said line that is less than said first distance, application of a load on said support member does not cause said first and second contact members to exert forces on said ring segment inner and outer surfaces, respectively, that generate friction forces that restrain rotation of said first link in said first direction, whereby said locking mechanism is disengaged and said support arm can be rotated in said first direction.

2. The apparatus according to claim 1, wherein said support arm further comprises a connecting member and a second link, said support member coupled to said connecting member portion of said support arm, said second end of said first link rotatably coupled to said connecting member at a second location, said second link having first and second ends, said first end of said second link rotatably coupled to said base at a third location displaced from said first location, said second end of said second link rotatably coupled to said connecting member at a fourth location displaced from said second location.

3. The apparatus according to claim 2, wherein said base and said connecting member and said first and second links form a four bar parallel bar linkage that causes the angular orientation of said connecting member to remain substantially constant as said support arm rotates about said base over said range of angular orientations.

4. The apparatus according to claim 2, wherein rotation of said connecting member about said second link at said fourth location causes displacement of said first link relative to said base.

5. The apparatus according to claim 1, wherein said first direction in which said rotation of said support arm is restrained is the downward direction.

6. The apparatus according to claim 1, wherein said locking mechanism does not restrain said support arm from rotating in a second direction opposite to said first direction.

7. The apparatus according to claim 1, wherein said support member is rotatably coupled to said second end of said support arm so as to be capable of being rotated over a range of angular orientations relative to said support arm, and further comprising a mechanism for locking said angular orientation of said support member relative to said support arm.

8. The apparatus according to claim 7, wherein said locking mechanism comprises a ratchet coupled to one of said support member or said support arm and a pawl coupled to the other of said support member or said support arm, said ratchet and pawl adapted to interengage so as to lock rotation of said support member relative to said support arm.

9. The apparatus according to claim 1, wherein said inner and outer arcuate surfaces of said ring segment define a thickness of said ring segment therebetween.

10. The apparatus according to claim 9, wherein said inner and outer arcuate surfaces of said ring segment have first and second radii of curvature, respectively, that define said center.

11. The apparatus according to claim 9, wherein the distance between said first and second contact members is no more than about 0.20 inch greater than the thickness of said ring segment.

12. The apparatus according to claim 1, wherein said first and second contact members are formed on said base and said ring segment is formed on said first end of said first link.

13. The apparatus according to claim 12, wherein said ring segment is formed by an opening formed in said first end of said first link, said second contact member projecting through said opening.

14. The apparatus according to claim 1, wherein said first and second contact members are formed on said first end of said first link and said ring segment is formed on said base.

15. The apparatus according to claim 1, wherein said first contact member has a surface that contacts said inner surface of ring segment when said center of said ring segment radius of curvature is displaced said first distance, and wherein the static coefficient of friction of said first contact member contact surface and said ring segment inner surface is at least 0.20.

16. The apparatus according to claim 15, wherein the static coefficient of friction of said first contact member contact surface and said ring segment inner surface is at least 0.70.

17. The apparatus according to claim 1, wherein said second contact member has a surface that contacts said outer surface of ring segment when said center of said ring segment radius of curvature is displaced said first distance, and wherein the static coefficient of friction of said second contact member contact surface and said ring segment outer surface is at least 0.20.

18. The apparatus according to claim 1, wherein said first and second contact members are cylindrical members projecting from said one of said base or said first link first end.

19. The apparatus according to claim 1, wherein said support member forms a support surface for supporting a keyboard thereon.

20. An adjustable support apparatus for supporting an object thereon that can be adjusted by a user, comprising:

(a) a base;

(b) a rotatable support arm capable of rotation relative to said base over at least a range of angular orientations, said support arm having first and second ends, said first end of said support arm coupled to said base so as to be capable of rotation about said base, said support arm comprising a locking member capable of both translation and rotation relative to said base;

(c) a support member for supporting said object, said support member coupled to said second end of said support arm, whereby a load on said support member imparts a moment to said support arm tending to rotate said support arm downward;

(d) an engageable and disengageable mechanism for locking downward rotation of said support arm about said base, comprising:

(i) first and second contact members formed on one of said base or said support arm locking member, said first and second contact members spaced apart by a distance, (ii) at least a segment of a ring formed on the other of said base or said support arm locking member, said ring segment having inner and outer arcuate surfaces and disposed between said first and second contact members, whereby translation of said support arm locking member causes translation of said ring segment relative to said contact members and rotation of said of said support arm locking member relative to said base causes relative rotation between said ring segment and said first and second contact members, wherein translating said support arm locking member in a first direction causes said first contact member to contact said inner surface of said ring segment and causes said second contact member to contact said outer surface of said ring segment, whereby said moment tending to rotate said support arm downward causes said first and second contact members to impart forces on said inner and outer surfaces, respectively, of said ring segment, said forces creating frictional forces that restrain relative rotation between said ring segment and said contact members, whereby said locking mechanism is engaged and said support arm is restrained from rotation in said downward rotation, and wherein translating said support arm locking member in a second direction opposite from said first direction causes said first and second contact members to lose contact with said inner and outer surfaces, respectively, of said ring segment, whereby said moment does not cause said contact members to impart forces on said ring segment surfaces that generate sufficient frictional forces to restrain relative rotation between said ring segment and said contact members, whereby said locking mechanism is disengaged and said support arm can be rotated in said downward rotation.

21. The apparatus according to claim 20, wherein said support member is coupled to said second end of said support arm by a connecting member, said connecting member mounted for rotation about said second end of said support arm, said support arm locking member coupled to said connecting member so that rotation of said connecting member relative to said support arm causes translation of said support arm locking member relative to said base, whereby rotation of said connecting member disengages said locking mechanism.

22. An adjustable support apparatus for supporting an object thereon that can be adjusted by a user, comprising:

(a) a base;

(b) a rotatable support arm capable of rotation relative to said base over at least a range of angular orientations, said support arm having first and second ends, said support arm comprising:

(i) a first link having first and second ends, said first end of said first link coupled to said base so as to be capable of both rotation about said base and displacement relative to said base, (ii) a second link having first and second ends, said first end of said second link rotatably coupled to said base, (iii) a connector rotatably coupled to said second end of said second link at a first location and coupled to said second end of said first link at a second location, wherein rotation of said connecting member in a clockwise direction about said first location causes said first link to be displaced away from said base, and wherein rotation of said connecting member in a counterclockwise direction about said first location causes said first link to be displaced toward said base;

(c) a support member for supporting said object, said support member coupled to said connecting member, wherein a downward force on said support member causes said connecting member to rotate counterclockwise so as to displace said first link toward said base, and wherein an upward force on said support member causes said connecting member to rotate clockwise so as to displace said first link away from said base;

(d) an engageable and disengageable mechanism for locking rotation of said support arm about said base in the downward direction, said mechanism comprising:

(i) first and second contact members formed on one of said base or said first link first end, said first and second contact members spaced apart by a distance, (ii) at least a segment of a ring formed on the other of said base or said first link first end, said ring segment having inner and outer arcuate surfaces each of which has a radius of curvature, said radii of curvature defining a thickness of said ring segment, said ring segment disposed between said first and second contact members, said distance by which said first and second contact members are spaced apart and said ring segment thickness and radii of curvature being selected so that (A) displacement of said first link toward said base in response to said downward force on said support member causes contact between said ring segment and said first and second contact members that restrains rotation of ring segment relative to said contact members in the counterclockwise direction, whereby said locking mechanism is engaged and said support arm is restrained from downward rotation, and (B) displacement of said first link away from said base in response to said upward force on said support member prevents contact between said ring segment and said first and second contact members sufficient to restrain rotation of ring segment relative to said contact members in the disengaged and said support arm can be rotated downward.

23. In an apparatus comprising a rotatable support arm capable of rotation relative to a base to which said support arm is coupled, an engageable and disengageable mechanism for restraining rotation of said support arm about said base in the downward direction, said mechanism comprising:

a) a restraining member having first and second ends, said first end of said restraining member coupled to said base so as to be capable of both rotation about said base and translation relative to said base, said second end of said restraining member coupled to said support arm so that rotation of said support arm about said base is restrained when rotation of said restraining member about said base is restrained;

b) first and second contact members formed on one of said base or said restraining member first end, said first and second contact members spaced apart by a distance; and c) at least a segment of a ring formed on the other of said base or said restraining member first end, said ring segment having inner and outer arcuate surfaces each of which has a radius of curvature, said radii of curvature defining a thickness of said ring segment, said ring segment disposed between said first and second contact members, said distance by which said first and second contact members are spaced apart and said ring segment thickness and radii of curvature being selected so that (A) translation of said restraining member toward said base causes contact between said inner and outer arcuate surfaces of said ring segment and said first and second contact members, respectively, that restrains rotation of ring segment relative to said contact members in the counterclockwise direction and thereby restrains rotation of said restraining member about said base, whereby said restraining mechanism is engaged and said support arm is restrained from downward rotation, and (B) translation of said restraining member away from said base prevents contact between said ring segment and said first and second contact members sufficient to restrain rotation of ring segment relative to said contact members in the counterclockwise direction, whereby said restraining mechanism is disengaged and said support arm can be rotated downward.

24. In a support apparatus for supporting an object thereon that can be adjusted by a user comprising:

(i) a base, (ii) a rotatable support arm capable of rotation relative to said base over at least a range of angular orientations, said support arm having first and second ends, said first end of said support arm coupled to said base so as to be capable of rotation about said base, at least a portion of said support arm coupled to said base so as to be capable of translation relative to said base, (iii) a support member for supporting said object, said support member coupled to said second end of said support arm, and (iv) an engageable and disengageable mechanism for locking downward rotation of said support arm about said base comprising (A) first and second contact members projecting from one of said base or said translatable portion of said support arm, said first and second contact members spaced apart by a distance, and (B) at least a segment of a ring formed on the other of said base or said translatable portion of said support arm, said ring segment having inner and outer arcuate surfaces and disposed between said first and second contact members; a method of engaging and disengaging said locking mechanism so as to restrain downward rotation of said support arm about said base, said method comprising:

(a) engaging said locking mechanism by translating said translatable portion of said support arm in a first direction so as to cause said first contact member to contact said inner surface of said ring segment and said second contact member to contact said outer surface of said ring segment; and (b) disengaging said locking mechanism by translating said translatable portion of said support arm in a second direction opposite from said first direction.

25. The method according to claim 24, wherein the step of engaging said locking mechanism by translating said translatable portion of said support arm in said first direction comprises applying a force that tilts said support member upward.

26. The method according to claim 25, wherein the step of disengating said locking mechanism by translating said translatable portion of said support arm in said second direction comprises releasing said force that tilts said support member upward.

* * * * *